United States Patent [19]

Hug

[11] 4,129,759

[45] Dec. 12, 1978

[54] PRESSURE RESPONSIVE CIRCUIT INTERRUPTER

[76] Inventor: Alfred J. T. Hug, Beustweg 3, 8032 Zurich, Switzerland

[21] Appl. No.: 706,127

[22] Filed: Jul. 16, 1976

[30] Foreign Application Priority Data

Jul. 18, 1975 [DE] Fed. Rep. of Germany ..... 2532295
Feb. 16, 1976 [DE] Fed. Rep. of Germany ..... 2606096

[51] Int. Cl.[2] ..... H01H 35/34
[52] U.S. Cl. ..... 200/83 R; 200/61.08
[58] Field of Search ..... 102/70.2; 200/264, 61.08, 200/81 R, 82 R, 83 A, 83 R; 340/58, 60, 240

[56] References Cited

U.S. PATENT DOCUMENTS 3,751,613 8/1973 Inose ..... 200/61.08
3,905,015 9/1975 Inose ..... 200/61.08
3,956,604 5/1976 Larker ..... 200/61.08

FOREIGN PATENT DOCUMENTS 915540 1/1913 United Kingdom ..... 200/61.08
1171951 11/1969 United Kingdom ..... 200/61.08

*Primary Examiner*—Gerald P. Tolin
*Attorney, Agent, or Firm*—Brisebois & Kruger

[57] ABSTRACT

A circuit interrupter with a frangible conductor which breaks to interrupt a circuit in response to an increase of fluid pressure above a predetermined level. In one version, the conductor is on a frangible member exposed to the pressure on one side and sealed by a cover and container on the side. In another version, a spring urged piston tensions a wire conductor and fluid pressure on the piston above the predetermined pressure breaks the wire. In another variation a diaphragm exposed to the pressure moves an element which ruptures the conductor when the pressure on the diaphragm exceeds the predetermined value.

12 Claims, 6 Drawing Figures

PRESSURE RESPONSIVE CIRCUIT INTERRUPTER

The invention relates to a pressure safety device for the interruption of a circuit when a predetermined pressure is exceeded.

Devices are known which upon the exceeding of a predetermined pressure open or close an electrical circuit by means of movable contacts. These devices exhibit the disadvantages of having relatively large dimensions and of too high a price for simple duties.

Known devices also have the disadvantage that depending on the media surrounding the contacts they become corroded so that safe opening or closing of them at an exactly defined pressure cannot be guaranteed.

A further disadvantage of the known devices consists in the fact that the circuit already opened after dropping of the pressure, for example, because of a defect in a component, may become closed again. This has a disadvantageous effect particularly in the case of the protection of oilfilled electrical components, since the circuit may be closed again only after removal of the cause of the disturbance.

An object of the invention is to avoid the disadvantages of the known devices, that is, in particular to create a pressure safety device of the above-mentioned kind, which guarantees reliable interruption of a circuit upon the exceeding of a predetermined pressure, and which, after response of the pressure safety device to the excess pressure, no longer become closed even on dropping back of the pressure.

According to the present invention a pressure-responsive safety device for interrupting an electrical circuit when a predetermined pressure is exceeded comprises a sealed cover, and a pressure-responsive element sealed from the ambient pressure by the cover, the element being arranged to be exposed to a pressure to be sensed and being so formed and connected to a frangible electrical conductor in such a way that when the predetermined pressure is exceeded the electrical conductor is caused to be broken by the pressure-responsive element thereby interrupting the electrical circuit of which the conductor forms a part.

Such a device which can be produced particularly cheaply and can be structurally formed so that it responds reliably after the exceeding of the permissible pressure but once and with which interruption of the circuit can be recognized without auxiliary means.

By the invention a particularly reliable interruption of the circuit is achieved thereby in a way of optimum simplicity, and further, closing of the circuit even after dropping of the pressure again is safely prevented, since the electrical conductor itself is broken.

Preferably the pressure-responsive element is a body of brittle material with an electrical conductor mounted or formed thereon, the element being arranged to be destroyed when the predetermined pressure is exceeded and thus to cause breaking of the conductor.

The body may be a tube or a plate and, advantageously the brittle material may be glass or an electrically conductive sintered metal.

The electrical conductor may, further advantageously, be an electrically conductive coating applied to the surface of the glass, whereby the costs of production of the glass body may be reduced to a minimum.

The pressure-sensitive element may be a partition arranged movably in a container and having fastened to it on one side a wirelike electrical conductor and on the other side a spring, the partition being so formed that upon the exceeding of the predetermined pressure it loads the electrical conductor under tension and breaks it, the spring being provided for prestressing the electrical conductor and for carrying electrical current.

Advantageously the cover and/or the container may be transparent, whereby a simple indication is enabled of the state of the pressure safety device.

In order to enable a universally usable pressure safety device which in addition after interruption of the circuit can be very quickly exchanged, the container may be attached removably to the housing of a component which is to be supervised.

The pressure safety device in accordance with the invention may advantageously be employed for the supervision of the pressure in components having oil-filled housings.

Advantageously, the pressure sensitive element may be a diaphragm which has a web for severing the electrical conductor and the electrical conductor may be fastened perpendicular to the direction of motion of the web and under prestress between two terminals in the range of influence of the web, whereby a raising of the release sensitivity of the pressure safety device may be achieved, since the force necessary for severing the electrical conductor does not depend directly upon the dimensional and strength tolerance of the electrical conductor. This is particularly so because the electrical conductor gets severed by a force from the web acting perpendicular to its extension.

Such a pressure safety device may further be produced significantly more cheaply by the employment of commercially available parts such as elecrical conductors, diaphragms, etc., since costly and individually manufactured parts can be dispensed with.

In a further refinement of the invention a cover provided with at least one opening may be provided at the side of the diaphragm exposed to pressure, whereby mechanical action against the diaphragm may be avoided.

The web may consist of electrical insulating material, whereby a pressure safety device totally insulated towards the outside is enabled.

Four examples of devices according to the invention will now be described with reference to the accompanying drawings, in which.

Figure 1:
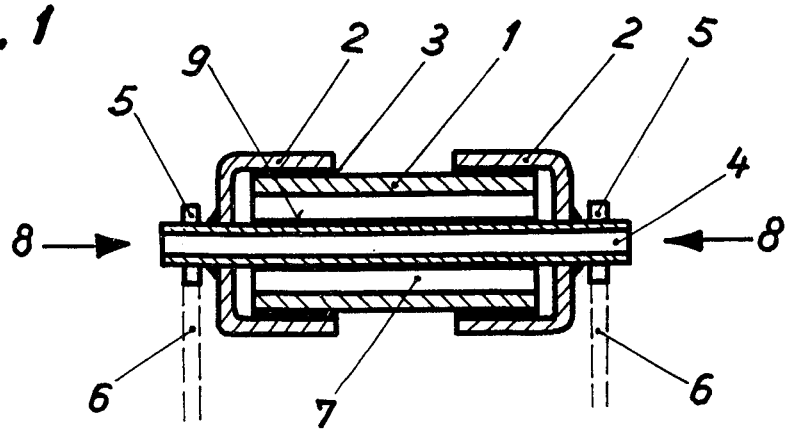
FIG. 1 is a longitudinal section through a first pressure safety device.

As may be seen from the longitudinal section in accordance with FIG. 1 this pressure safety device consists of a container 1, a cover 2 and a glass tube 4 arranged inside the container 1. The glass tube 4 is formed longer than the container 1 so that the ends of the glass tube project through the cover 2.

The components of the pressure safety device are connected together in such a way that the container 1 and the cover 2 form, by means of seals 3, a vessel which is pressure-tight against the atmosphere, in which the glass tube 4 is arranged. The glass tube 4 is likewise fastened by means of seals 5 to be pressure-tight to the cover 2 and has, on the surface of the glass, an electrically conductive coating 9 and two terminals 6 fastened to the ends.

The pressure to be supervised is that applied to the openings 8 in the glass tube 4.

If the pressure in a component to be supervised now rises the pressure inside the glass tube 4 likewise rises. The glass tube 4 is dimensioned in such a way that upon the exceeding of the permissible pressure it is destroyed. This is so because the pressure difference between the inside of the glass tube 4 and the space 7 formed between the glass tube 4 and the container 1 rises to correspond with the rise in pressure inside the component to be supervised, since the volume of the space 7 and therefore the pressure inside it remain nearly the same.

Through the destruction of the glass tube 4 the electrically conductive coating 9 is likewise destroyed and hence the circuit is interrupted.

In order to supervise the state of the pressure safety device the container 1 is produced from transparent material such, for example, as glass, safety glass, etc.

Figure 2:
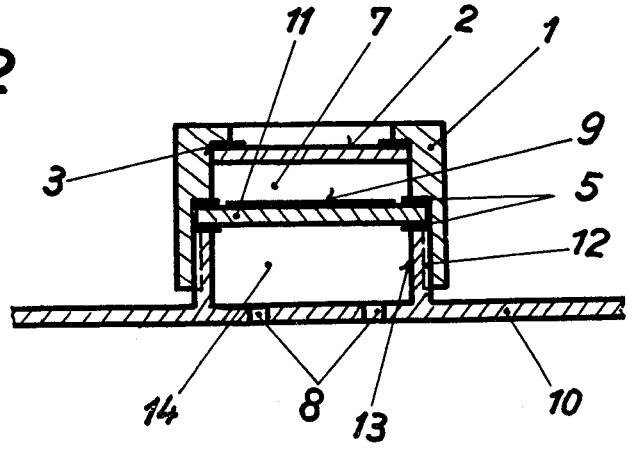
FIG. 2 is a longitudinal section through a modified device.

The example shown in FIG. 2 has a cylindrical container 1 on the top end of which a cover 2 is arranged in a pressure-tight manner by means of seals 3, and at the bottom end of which a thread 12 is provided for screwing the container 1 onto a flange 13 on a housing 10 not shown in greater detail.

Inside the container 1 a glass plate 11 is arranged in such a way that a first space 7 is formed between the cover 2 and the glass plate 11 and a second space 14 between the glass plate 11 and the housing 10. The first space 7 and the second space 14 are besides separated from one another in a pressure-tight manner by means of seals 5.

The housing 10 includes openings 8 for connection to the second space 14 of pressure medium on the inside of the housing 10. The glass plate 11 exhibits an electrically conductive coating on the surface of the glass.

If the pressure inside the housing 10 now rises the pressure in the second space 14 likewise rises, whilst the pressure in the first space 7 remains nearly constant.

The glass plate 11 is dimensioned in such a way that upon the exceeding of the permissible pressure it is destroyed and consequently the conductive coating 9 is interrupted.

In order to supervise the state of the pressure safety device the cover 2 is produced from transparent material such, as, for example, glass, safety glass, etc.

Figure 3:
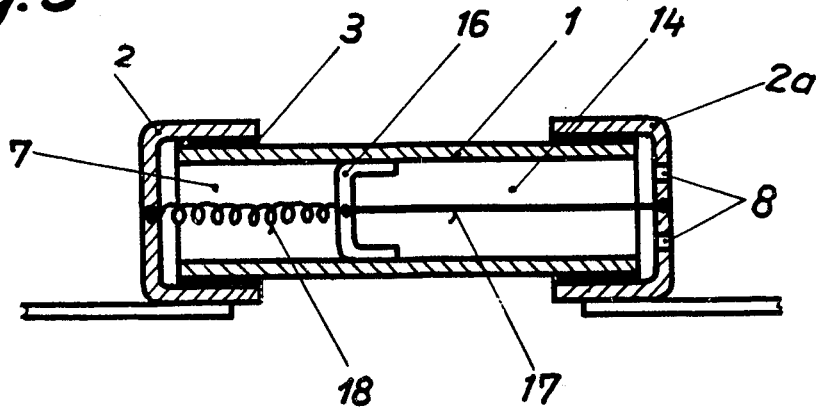
FIG. 3 is a longitudinal section through a further device.

FIG. 3 shows a further example which consists of a container 1, a first cover 2, a second cover **2*a* and a piston 16 arranged to slide in the container 1**.

The piston 16 is fastened by means of a wirelike conductor 17, at one end to the piston and at the other end to the second cover **2*a*, and a spring 18 which is fastened at one end to the piston and at the other end to the first cover 2, is held in an accurately determined position. A tension spring 18 is in addition used for carrying the current through the conductor 17 and for removing the piston 16** with the part of the conductor remaining upon the rupture of the conductor, from the rest of the conductor, in order thus to prevent closing of the circuit after a interruption.

The second cover **2*a* has openings 8 for connection of the space 14 between the piston 16 and the second cover 2*a*** to the space under pressure which is to be supervised.

If the pressure inside the space to be supervised now rises the pressure in the space 14 likewise rises. This rise in pressure produces a force on the piston 16 which loads the conductor in tension. If the pressure in the space 14 exceeds the permissible pressure the tensile force acting on the conductor exceeds the breaking stress of the conductor whereby the latter is interrupted.

In order to supervise the state of the pressure safety device the container 1, is again produced from transparent material such, as, for example, glass, safety glass, etc.

Clearly, the containers shown in FIGS. 1 and 3 in a similar way to the pressure safety device as FIG. 2 can include a thread for fastening the pressure safety device onto the housing of the component which is to be supervised, whereby quick exchange of destroyed pressure safety deviced is enabled.

The electrically conductive coating 9 provided on the glass tube 4 or on the glass plate 11 may also, as is readily obvious to those skilled in the art, be substituted by an electrically conductive filament which is either arranged at the surface of the glass or even embedded in the glass mass.

Figure 4:
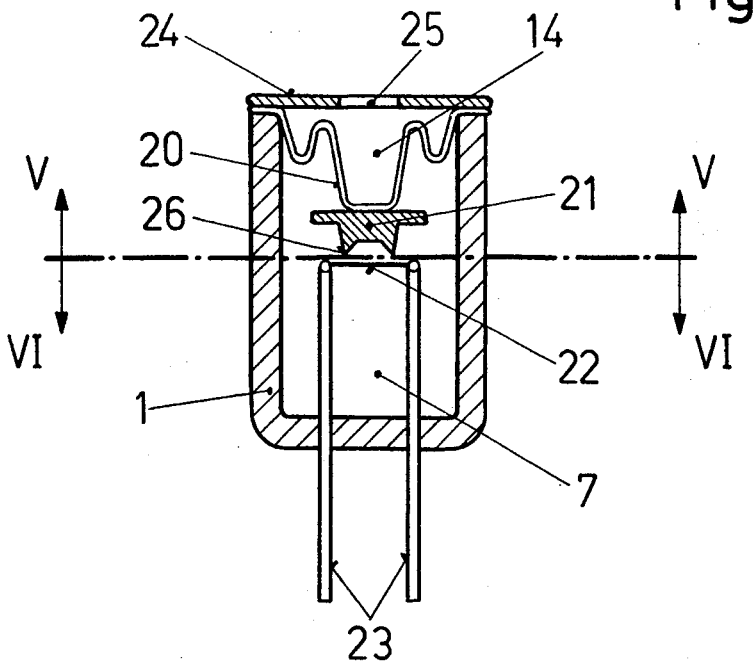
FIG. 4 is a longitudinal section through a fourth device.

As may be seen from the longitudinal section as FIG. 4 a fourth pressure safety device consists of a cylindrical container 1 exhibiting a cover, a diaphragm 20, to which a web 21 is fastened, covering and sealing the container, and also of an electrical conductor 22 fastened between two terminals 23.

In the region of the diaphragm 20 a cover 24 is provided to protect the diaphragm and is provided with at least one passage 25.

Manifestly the pressure safety device is formed in such a way that it can readily be introduced into the housing which is to be supervised without any special fastening of the pressure safety device being needed. This is especially so because the pressure safety device has a first space 7 which is in itself closed off and which is under nearly constant pressure.

If the pressure inside the housing now rises the pressure — because of the opening 25 — inside a second space 14 formed by the cover 24 and the diaphragm 20 likewise rises, whilst the pressure in the first space 7 remains nearly constant. The diaphragm 20 and the electrical conductor 22 are in that case so dimensioned that upon the exceeding of the permissible pressure and hence upon the exceeding of the permissible force acting on the electrical conductor 22 the latter is severed by the web 21 and consequently the electrical circuit is interrupted.

Figure 5:
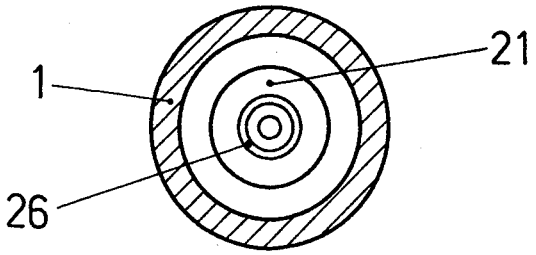
FIG. 5 is a cross-section along line V in FIG. 4.

FIG. 5 shows a section along line V in FIG. 4, from which the circular form of the web 21 may be seen. The web 21 exhibits in addition a circular crusher-portion 26 which is wedge-shaped in cross-section.

Figure 6:
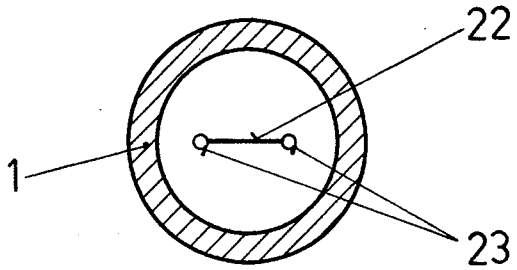
FIG. 6 is a cross-section along line VI in FIG. 4.

By the circular formation of the web 21 and the crusher-portion 26 respectively the assembly of the pressure safety device is considerably simplified, since alignment of the web is not necessary. This may be seen especially from FIG. 6, wherein it can be seen that the electrical conductor 22 is wirelike in form.

I claim:

1. A pressure-responsive circuit interrupter safety device for interrupting an electrical circuit when a predetermined pressure of a fluid pressure medium is exceeded, said device comprising an enclosure having an opening, a pressure-responsive element closing said opening with respect to said pressure to be sensed and defining a sealed space in said enclosure, said element being adapted to be exposed to said pressure to be sensed; a frangible electrical conductor adapted to be connected in said electrical circuit; said element comprising a body of glass, and said electrical conductor comprising an electrically conductive coating applied to a surface of said body of glass, said pressure-responsive element being destroyed when said predetermined sensed pressure is exceeded so that said conductor is broken and said electrical circuit is interrupted.

2. A device according to claim 1, wherein said pressure-responsive element is a tube.

3. A device according to claim 1, wherein said pressure-responsive element is a plate.

4. A pressure-responsive circuit interrupter safety device for interrupting an electrical circuit when a predetermined pressure of a fluid pressure medium is exceeded, said device comprising an enclosure having an opening, a pressure-responsive element closing said opening with respect to said pressure to be sensed and defining a sealed space in said enclosure, said element being adapted to be exposed to said pressure to be sensed; said pressure responsive element comprising a partition moveable in said enclosure; a wire-like electrical conductor adapted to be connected in said electrical circuit, said conductor being fastened to said partition on one side thereof and being fastened at a location spaced from said partition to means supported by said enclosure: a spring electrically connected to said conductor and fastened to said partition on the other side thereof and fastened at a location spaced from said partition to means supported by said enclosure, said spring prestressing said conductor, said partition loading said conductor under tension when said predetermined pressure is exceeded so that said conductor is broken.

5. A device according to claim 4, wherein said partition is a diaphragm.

6. A device according to claim 4, wherein said partition is a piston, said piston being arranged to slide in said enclosure.

7. A device according to claim 4, wherein at least a portion of said enclosure is transparent.

8. A pressure-responsive circuit interrupter safety device for interrupting an electrical circuit when a predetermined pressure of a fluid pressure medium is exceeded, said device comprising an enclosure having an opening, a pressure-responsive element closing said opening, and defining a sealed space in said enclosure, said element being adapted to be exposed to said pressure to be sensed; a frangible electrical conductor adapted to be connected in said electrical circuit, said pressure responsive element comprising a diaphragm, means on said diaphragm for severing said electrical conductor, said electrical conductor being fastened perpendicular to the direction of motion of said means and being positioned between and prestressed between two terminals, said electrical conductor being ruptured when said predetermined pressure is exceeded so that said electrical circuit is interrupted.

9. A device according to claim 8, wherein at the side of said diaphragm exposed to said pressure to be sensed a cover is provided, said cover defining an opening for supply of said pressure to said element.

10. A device according to claim 8, wherein said means for severing said electrical conductor includes an element having a circular pressure-portion, said element further being wedge-shaped in cross-section.

11. A device according to claim 8, wherein said pressure-responsive element is connected firmly to said severing means.

12. A device according to claim 8, wherein said element comprises an electrically insulating material.

* * * * *